US011396765B2

(12) United States Patent
Uchida

(10) Patent No.: US 11,396,765 B2
(45) Date of Patent: Jul. 26, 2022

(54) HINGE AND HINGE ROLL

(71) Applicant: INTERNATIONAL METEOROLOGICAL CONSULTANT INC., Tokyo (JP)

(72) Inventor: Yoshihisa Uchida, Tokyo (JP)

(73) Assignee: INTERNATIONAL METEOROLOGICAL CONSULTANT INC., Tokyo (JP)

( * ) Notice: Subject to any disclaimer, the term of this patent is extended or adjusted under 35 U.S.C. 154(b) by 72 days.

(21) Appl. No.: 16/626,323

(22) PCT Filed: Jun. 13, 2018

(86) PCT No.: PCT/JP2018/022583
§ 371 (c)(1),
(2) Date: Dec. 24, 2019

(87) PCT Pub. No.: WO2019/009031
PCT Pub. Date: Jan. 10, 2019

(65) Prior Publication Data

US 2020/0115939 A1 Apr. 16, 2020

(30) Foreign Application Priority Data

Jul. 3, 2017 (JP) ..... JP2017-130731

(51) Int. Cl.
*E05D 1/00* (2006.01)
*E05D 1/02* (2006.01)

(52) U.S. Cl.
CPC ..... *E05D 1/02* (2013.01)

(58) Field of Classification Search
CPC ..... E05D 1/02
See application file for complete search history.

(56) References Cited

U.S. PATENT DOCUMENTS 3,198,228 A * 8/1965 Naito ..... B65D 33/2533 383/65
3,445,052 A * 5/1969 Lewallen ..... E05D 1/02 16/385

(Continued)

FOREIGN PATENT DOCUMENTS

JP S50-70766 A 6/1975
JP S61-3241 U 1/1986

(Continued)

OTHER PUBLICATIONS

International Search Report in PCT Application No. PCT/JP2018/022583, dated Jul. 24, 2018, 4pp.

*Primary Examiner* — Jason W San
(74) *Attorney, Agent, or Firm* — Hauptman Ham, LLP

(57) ABSTRACT

A hinge for connecting a first pivoting body to a second pivoting body in a relatively pivotable manner includes a sheet body configured to attach a first end of the sheet body to the first pivoting body, and to attach a second end of the sheet body to the second pivoting body. The sheet body includes a plurality of layered sheet members, and a pivot shaft between layered sheet members of the plurality of layered sheet members to allow the first end and the second end of the sheet body to pivot relative to each other. The pivot shaft includes a soft resin part between the layered sheet members.

12 Claims, 17 Drawing Sheets

(56) References Cited

U.S. PATENT DOCUMENTS 4,704,837 A * 11/1987 Menchetti ..... E04C 2/043 52/273
5,945,053 A * 8/1999 Hettinga ..... E05D 1/02 264/171.13
6,772,479 B2 * 8/2004 Hinkley ..... E05D 1/02 16/225
6,901,637 B2 * 6/2005 Machacek ..... B65D 33/2525 24/30.5 R
7,350,641 B2 * 4/2008 Smyth ..... G11B 33/0422 206/308.1
7,556,429 B2 * 7/2009 Taheri ..... B65D 31/12 383/38
7,685,676 B2 * 3/2010 Mc Clellan ..... E05D 1/02 16/225
9,248,786 B2 * 2/2016 Suzuki ..... B29C 70/46
9,868,473 B2 * 1/2018 Ishii ..... B32B 3/30
10,179,642 B1 * 1/2019 Van Pelt ..... B32B 5/12
10,422,169 B2 * 9/2019 Christenson ..... E05D 1/02
10,905,203 B2 * 2/2021 Burkhart-Day ..... A44B 19/34
2003/0211924 A1 * 11/2003 Carney ..... G11B 33/0494 493/84
2005/0008266 A1 * 1/2005 Crunkleton ..... B65B 61/188 383/5
2007/0053504 A1 * 3/2007 Sato ..... F16C 11/12 379/156
2008/0045093 A1 2/2008 Tamba et al.
2009/0104949 A1 4/2009 Sato et al.
2012/0176736 A1 * 7/2012 Apgar ..... E05D 1/02 361/679.01
2014/0007376 A1 * 1/2014 Brewer ..... E05D 1/02 16/225
2014/0007377 A1 * 1/2014 Masini ..... F16C 11/12 16/225
2015/0040349 A1 * 2/2015 Malia ..... B29C 66/73753 16/225
2016/0130413 A1 * 5/2016 Reid ..... B29C 51/082 16/225
2016/0139634 A1 * 5/2016 Cho ..... G06F 1/1652 361/679.27
2016/0145919 A1 * 5/2016 Howell ..... E05D 1/02 16/225
2017/0023986 A1 * 1/2017 Xin ..... E05D 15/0621
2017/0044808 A1 * 2/2017 Liao ..... E05D 1/02
2019/0382164 A1 * 12/2019 Sprehe ..... B65D 33/2525
2020/0123820 A1 * 4/2020 Lin ..... C08L 23/18
2021/0180377 A1 * 6/2021 Ishii ..... B29C 51/306

FOREIGN PATENT DOCUMENTS

JP S61-3872 U 1/1986
JP S61-80142 U 5/1986
JP S64-37876 U 3/1989
JP H5-14988 U 2/1993
JP H7-217297 A 8/1995
JP H7-243278 A 9/1995
JP H8-270313 A 10/1996
JP H10-299318 A 11/1998
JP 2001-207716 A 8/2001
JP 3079393 U 8/2001
JP 3085697 U 5/2002
JP 2006-77558 A 3/2006
JP 2007-126875 A 5/2007
JP 2010-84411 A 4/2010
JP 2010-144434 A 7/2010
JP 2016-35172 A 3/2016
JP 2017-2649 A 1/2017
WO 2005/043868 A1 5/2005

* cited by examiner

HINGE AND HINGE ROLL

RELATED APPLICATIONS

The present application is a national stage filing under 35 U.S.C § 371 of PCT application number PCT/JP2018/022583 filed on Jun. 13, 2018 which is based upon and claims the benefit of priority to Japanese Patent Application No. 2017-130731, filed on Jul. 3, 2017.

TECHNICAL FIELD

The present invention relates to a hinge to connect one pivoting body to another pivoting body in a relatively pivotable manner and to a hinge roll.

BACKGROUND

Conventionally, a hinge has been used to pivotably connect an opening frame (door frame) and a shield (door), for example.

The hinge typically includes a pair of flat vanes and a pivot shaft that pivotably connects these vanes (for example, refer to Patent Literature 1). One vane is attached to the opening frame and the other vane is attached to the shield, so that the opening frame and the shield are pivotably connected around the pivot shaft.

CITATION LIST

Patent Document
Patent Literature 1: JP 2016-35172 A

SUMMARY

Problem to be Solved

However, with this hinge, when a failure occurs in coupling the opening frame and the shield, pivoting motion of the opening frame or the shield is not made smoothly, or noise occurs during the pivoting thereof.

Considering the foregoing, an object of the present invention is to provide a hinge that allows pivoting bodies to smoothly pivot relative to each other, and a hinge roll.

Solution to Problem

A hinge according to the present application is a hinge to connect one pivoting body to another pivoting body in a relatively pivotable manner, the hinge including a sheet body that is configured by layering sheet members, one end of the sheet body being attachable to the one pivoting body and another end of the sheet body being attachable to the other pivoting body, the sheet body including a pivot shaft that is disposed between the layered sheet members so as to allow the one end and the other end of the sheet body to pivot relative to each other.

Advantageous Effects

One aspect of the present application allows pivoting bodies to smoothly pivot relative to each other.

DETAILED DESCRIPTION

First Embodiment

The following describes a hinge according to a first embodiment of the present invention with reference to the drawings.

Figure 1:
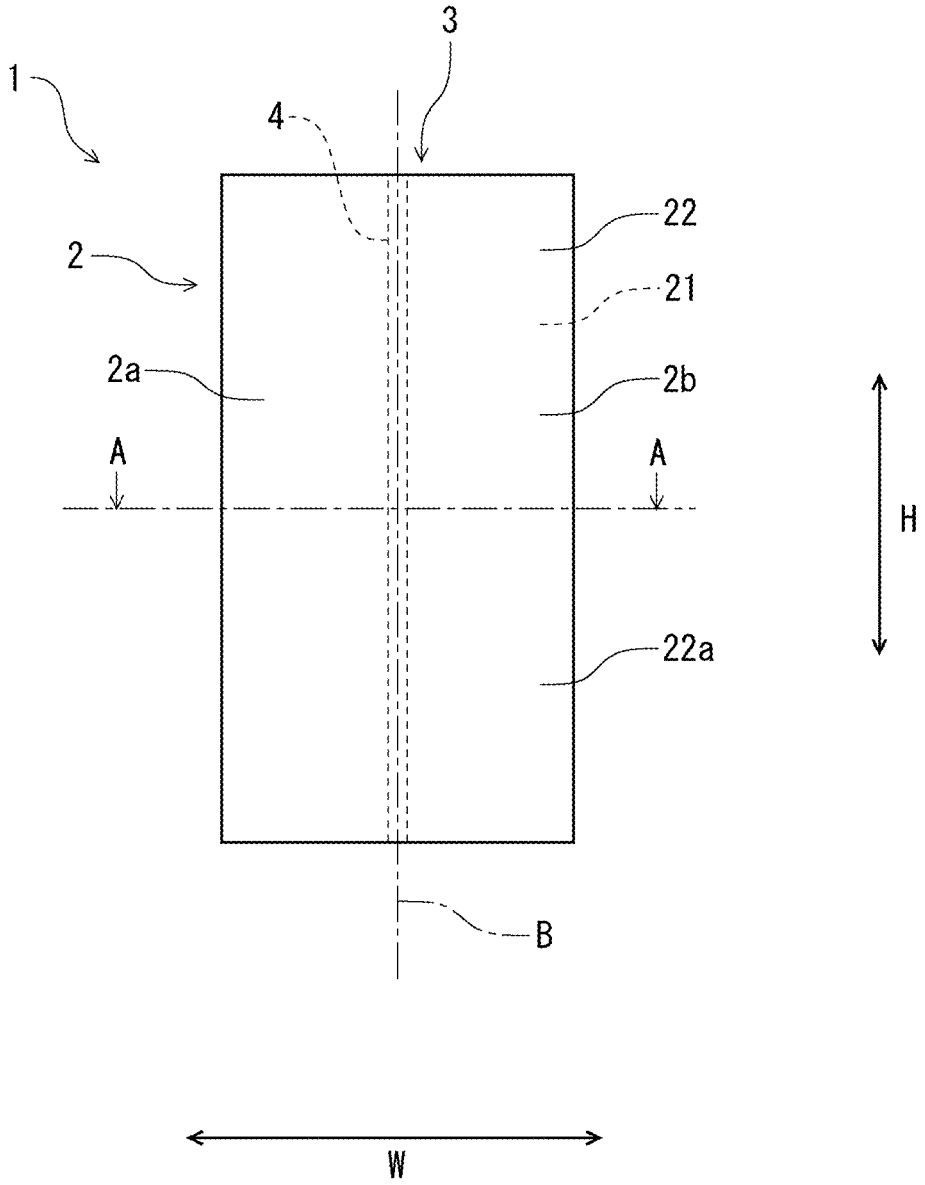
FIG. 1 is a plan view illustrating a hinge according to a first embodiment of the present invention.
Figure 2:
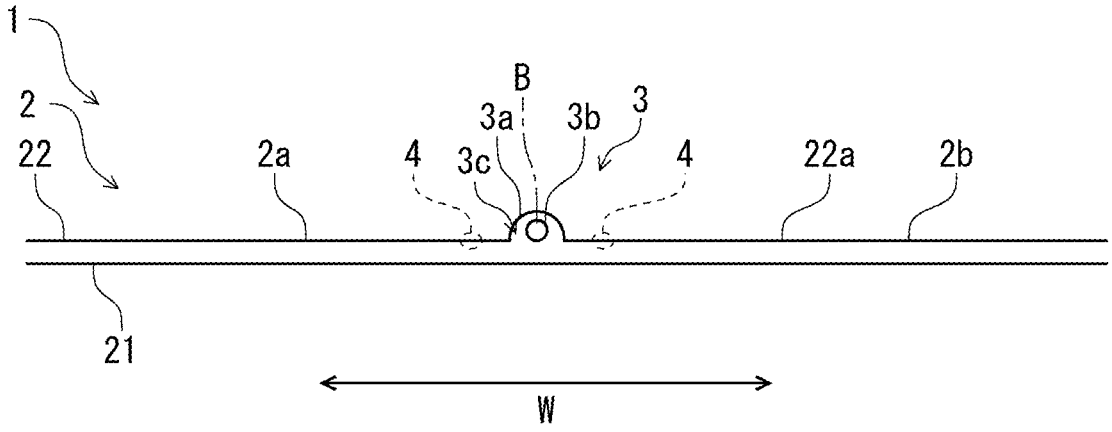
FIG. 2 is a sectional view illustrating an enlarged section along line A-A in FIG. 1.
Figure 3:
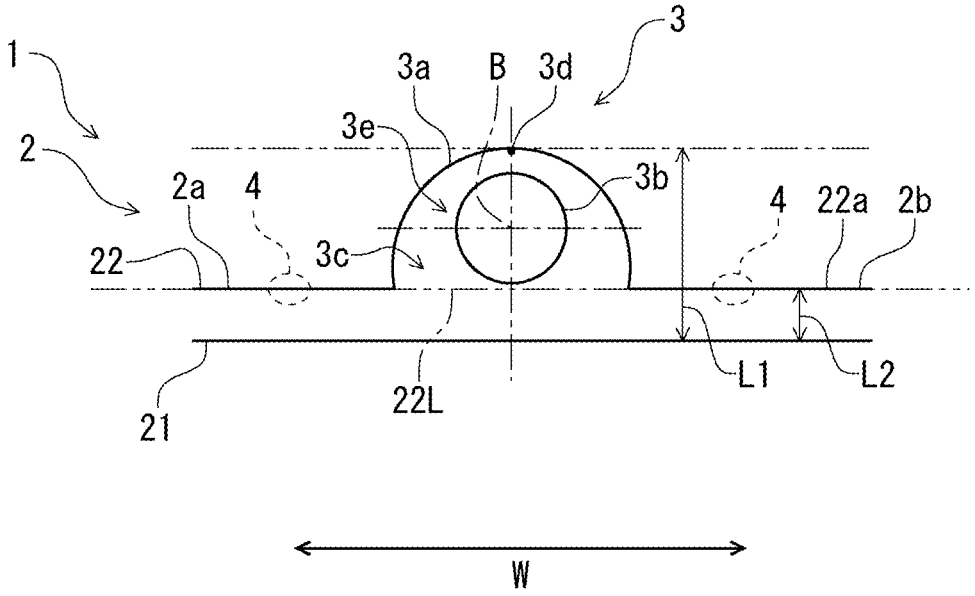
FIG. 3 is a sectional view illustrating an enlarged part in FIG. 2.

FIG. 1 to FIG. 3 illustrate a hinge 1, which is the first embodiment of the present invention.

The hinge 1 includes a sheet body 2 that has a rectangular sheet-like shape.

The sheet body 2 has one end 2*a* on one end in a width direction W thereof that is attachable to a door frame (one pivoting body), and another end 2*b* on the other end thereof that is attachable to a door (another pivoting body).

The sheet body 2 is configured with a first sheet member 21 and a second sheet member 22 that are flexible and are formed of fibers such as carbon fibers, being layered in a thickness direction.

The first sheet member 21 and the second sheet member 22 each include fibers woven with inclination from one end to the other end of a height direction H with respect to a pivot shaft 3, which will be described later. Specifically, at least part of the fibers in the first sheet member 21 and the second sheet member 22 is arranged with inclination at 45 degrees with respect to the pivot shaft 3.

The first sheet member 21 and the second sheet member 22 are bonded to one another on the one end 2*a* and the other end 2*b* with an unillustrated adhesive agent, resin, or the like.

The sheet body 2 is provided with the pivot shaft 3 in a center part thereof in the width direction W.

The pivot shaft 3 includes a bulge 3*a* and an axial member 3*b*.

The bulge 3*a* is integrally configured with the second sheet member 22 with the center part thereof in the width direction W bulging outward in a curved manner on one major face 22*a* side of the second sheet member 22. The bulge 3*a* has an inner space 3*c* that is decentered toward the one major face 22*a* side. Specifically, as illustrated in FIG. 3, the space between the highest bulge point 3*d* that bulges farthest from the inner face of the bulge 3*a* and the inner face of the first sheet member 21 lies on the one major face 22*a* side. In other words, a thickness L1 between the highest bulge point 3*d* and the inner face of the first sheet member 21 is larger, on the one major face 22*a* side, than a thickness L2 between the first sheet member 21 at the one end 2*a* or the other end 2*b* and the second sheet member 22.

The inner space 3*c* of the bulge 3*a* houses the axial member 3*b* that extends in an elongated manner. The axial member 3*b* is formed of a nylon wire and the like, for example, and is extended over the overall length in the height direction H of the sheet body 2. The axial member 3*b* is provided in a decentered space 3*e* between the highest bulge point 3*d* and a virtual line 22L on the one major face 22*a*, in the inner space 3*c*. Specifically, the axial member 3*b* is provided in the inner space 3*c* so as to be decentered toward the one major face 22*a* side.

It should be noted that the pivot shaft 3 allows the one end 2*a* and the other end 2*b* to pivot relative to each other, with the axial member 3*b* serving as a pivot center B during the relative pivoting. Specifically, since the axial member 3*b* is provided in the inner space 3*c* so as to be decentered toward the one major face 22*a* side, the pivot center B is set so as to be decentered toward the one major face 22*a* side.

The relative pivoting refers to the pivoting of the one end 2*a* and the other end 2*b* relative to each other, and includes the pivoting of the other end 2*b* alone with the one end 2*a* fixed, the pivoting of the one end 2*a* alone with the other end 2*b* fixed, and the pivoting of both the one end 2*a* and the other end 2*b*, for example.

As illustrated in FIG. 1, in the sheet body 2, the one major face 22*a* of the second sheet member 22 includes an identification part 4 that is a line of a stitched seam. A pair of the identification parts 4 are provided to respective ends of the pivot shaft 3 in the width direction W, and are extended over the overall length of the pivot shaft 3 in the height direction H. This identification part 4 makes the position of the pivot shaft 3 easily visually recognized from the outside.

The hinge 1 is manufactured with the following process, for example.

Figure 4:
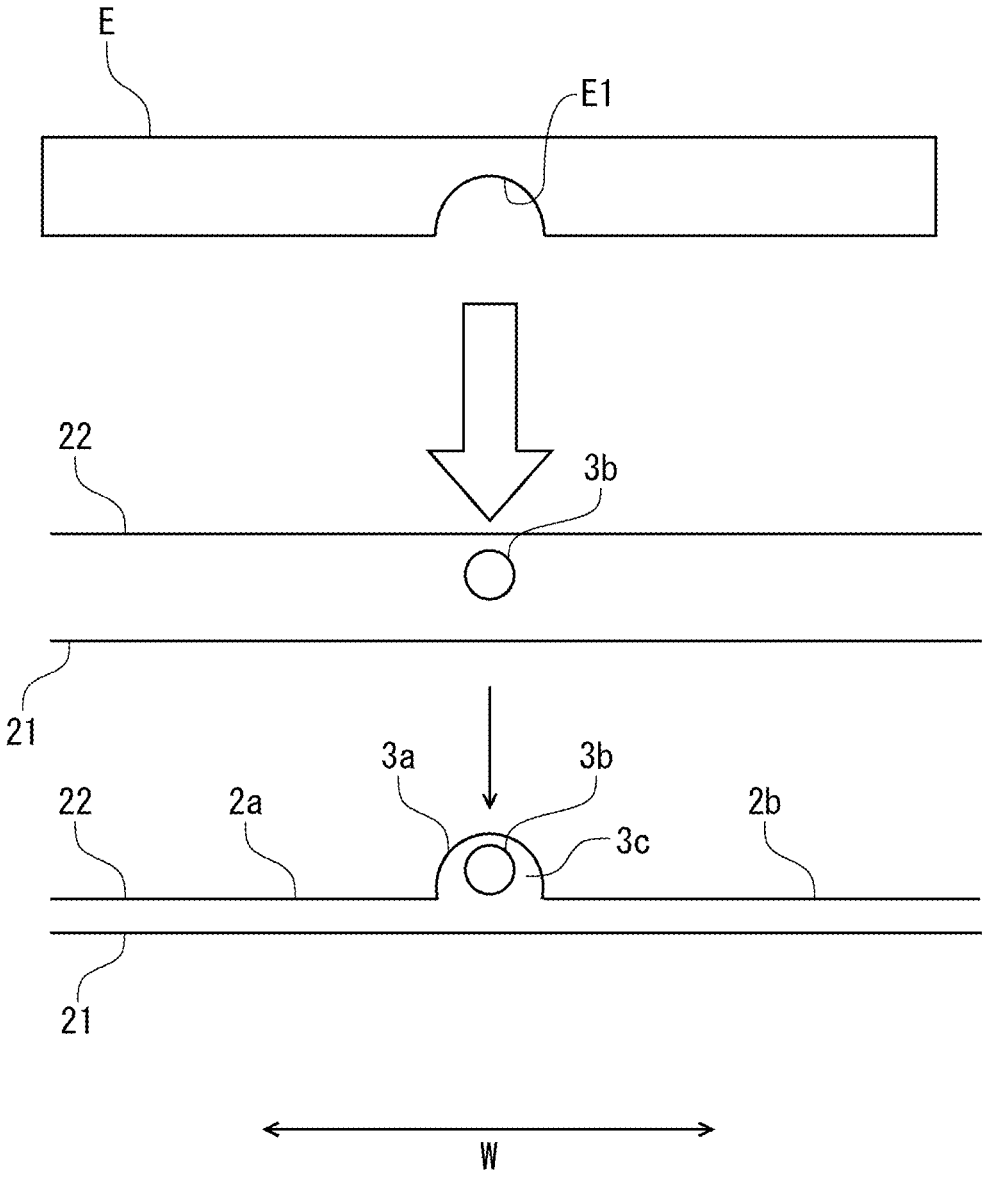
FIG. 4 is an explanatory diagram illustrating a manufacturing process of the hinge in FIG. 1.

In FIG. 4, symbol E denotes a pressing die. A pressing face of the pressing die E has a recess E1 formed thereon.

First, the first sheet member 21 and the second sheet member 22 are stacked one on another in the thickness direction thereof with the axial member 3*b* interposed therebetween. Then, with a portion having the axial member 3*b* disposed therein in the second sheet member 22 and the recess E1 facing vertically opposite to each other, the pressing die E descends to the second sheet member 22 from above, and at a certain time, the pressing face contacts the second sheet member 22. The pressing face further presses the second sheet member 22 downward.

In this process, with the one end 2*a* and the other end 2*b* being pressed with the pressing face, the portion opposite to the recess E1 in the second sheet member 22 is pressed to the inner face of the recess E1 while being retained inside the recess E1 together with the axial member 3*b*, so that the bulge 3*a* is formed that bulges according to the shape of the recess E1. Consequently, the inner space 3*c* is formed inside the bulge 3*a*, so that the axial member 3*b* is disposed in the inner space 3*c*.

Figure 5:
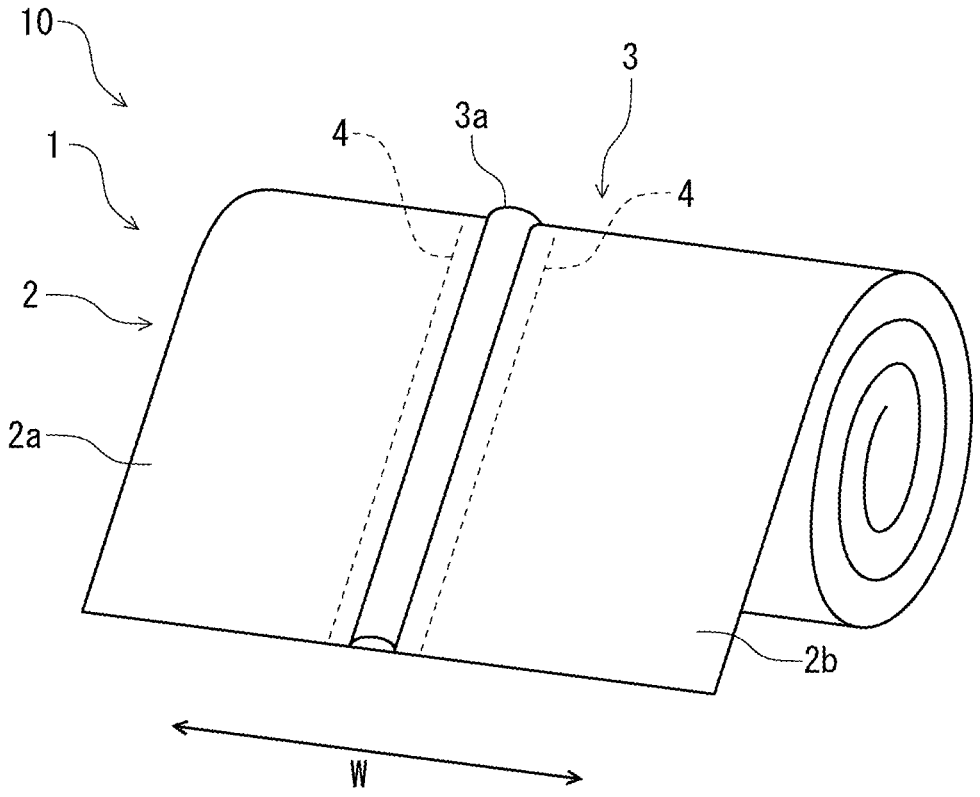
FIG. 5 is a perspective view illustrating a hinge roll.

As illustrated in FIG. 5, a hinge roll 10 is formed with a plurality of sheet bodies 2 integrally rolled in a roll shape. Specifically, the hinge roll 10 is a roll including a plurality of hinges 1 integrally rolled in a roll shape.

The hinge roll 10 is cut in a direction crossing the longitudinal direction to produce the hinge 1 in FIG. 1.

Next, operations or the like of the hinge 1 will be described with reference to FIG. 6A to FIG. 8.

Figure 7:
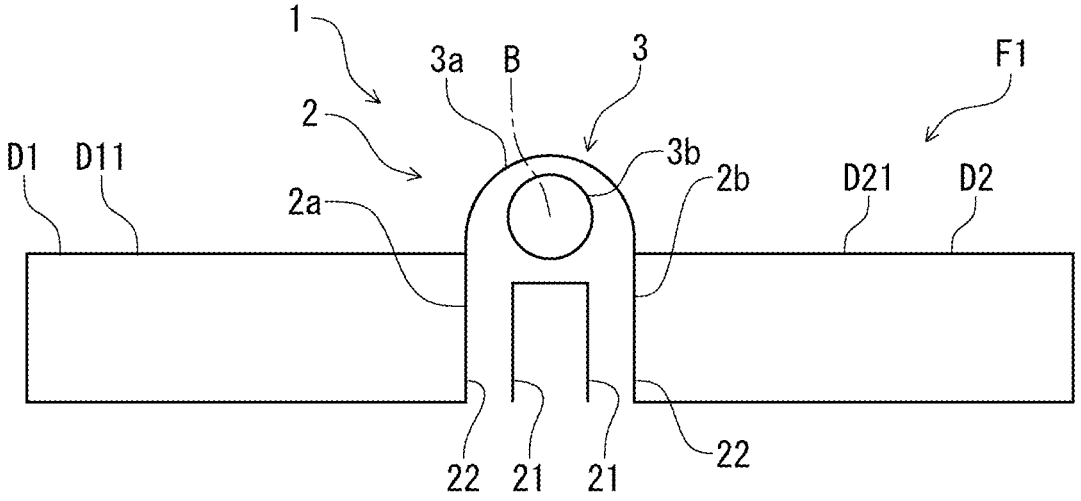
FIG. 7 is an explanatory diagram illustrating an enlarged part in FIG. 6A.
Figure 8:
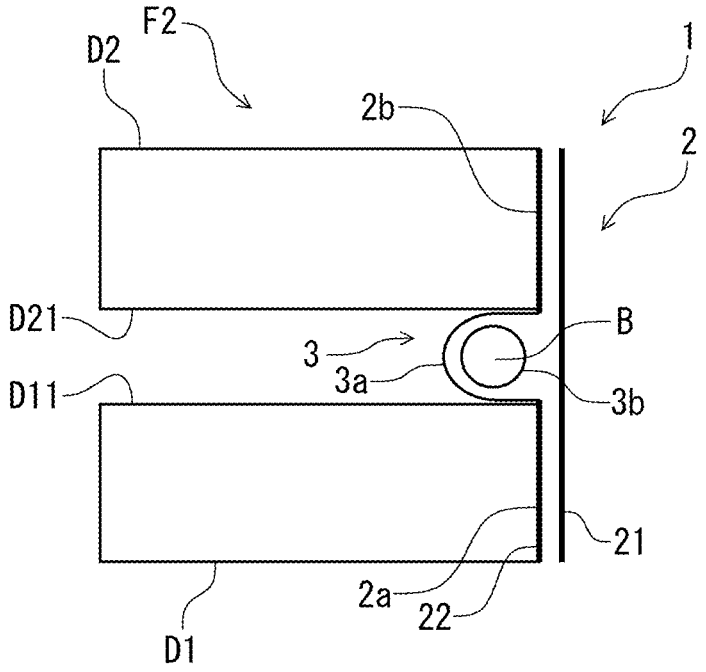
FIG. 8 is an explanatory diagram illustrating an enlarged part in FIG. 6C.

Symbol D1 denotes a door frame and D2 denotes a door. FIG. 7 and FIG. 8 illustrate only a part of the door frame D1 and the door D2.

Figure 6A:
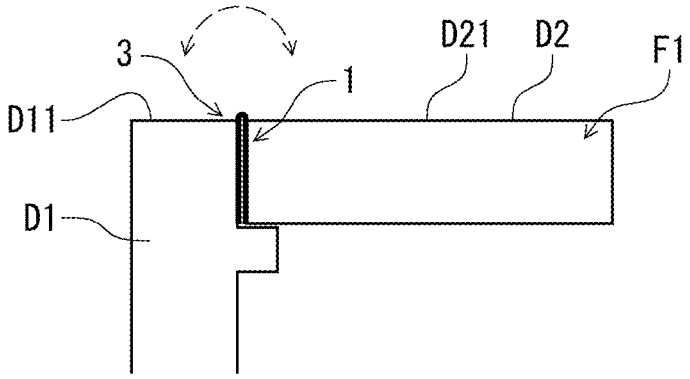
FIGS. 6A to 6C illustrate the hinge in FIG. 1 attached to a door frame and a door, FIG. 6A being an explanatory diagram illustrating the door being closed, FIG. 6B being an explanatory diagram illustrating the door being opened at 90 degrees, and FIG. 6C being an explanatory diagram illustrating the door being opened at 180 degrees.

As illustrated in FIG. 6A and FIG. 7, the one end 2*a* is attached to the door frame D1 with screws or an adhesive agent, and the other end 2*b* is attached to the door D2 with screws or an adhesive agent.

In this case, at least part of the fibers of the first sheet member 21 and the second sheet member 22 is arranged with inclination downward from the one end 2*a* to the other end 2*b*. Specifically, the at least part of the fibers of the first sheet member 21 and the second sheet member 22 is arranged with inclination downward from the door frame D1 to the door D2.

It should be noted that in FIG. 6A and FIG. 7, the door D2 is in a closed state with respect to the door frame D1. Specifically, the door D2 is arranged in a close position F1.

In this case, the sheet body 2 is in a folded state by pivoting relative to the first sheet member 21 side with the axial member 3*b* serving as the pivot center B. Then, a plane D11 of the door frame D1 and a plane D21 of the door D2 are arranged flush with one another, and the pivot shaft 3 is arranged in a position in which the pivot shaft 3 projects outward from the planes D11 and D21.

Figure 6B:
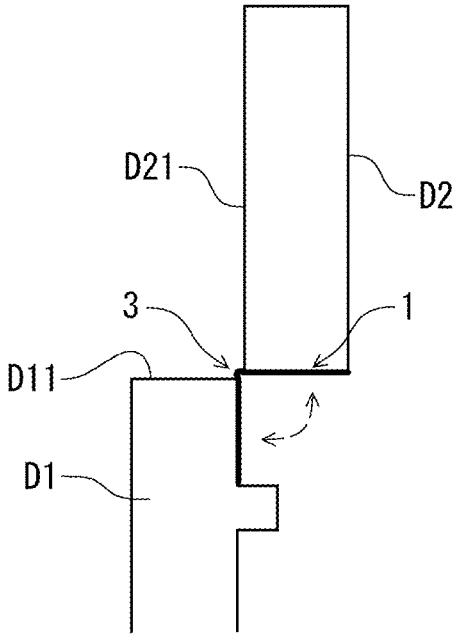

In the above-described state, a user is opening the door D2 with respect to the door frame D1. Then, as illustrated in FIG. 6B, the other end 2*b* pivots relative to the one end 2*a* with the axial member 3*b* serving as the pivot center B. Consequently, the door D2 pivots relative to the door frame D1 with the axial member 3*b* serving as the pivot center B. As the door D2 is further opened, the other end 2*b* further pivots relative to the one end 2*a* with the axial member 3*b* serving as the pivot center B.

Figure 6C:
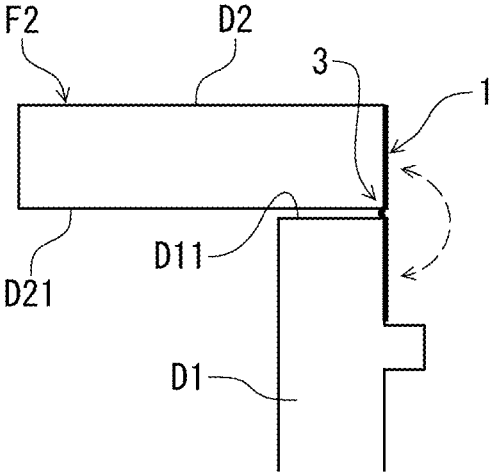

Then, as illustrated in FIG. 6C and FIG. 8, the plane D21 of the door D2 contacts the plane D11 of the door D1, so that the relative pivoting between the door D2 and the door frame D1 is restricted.

In this case, the door D2 is arranged in an open position F2 in which the door D2 is opened at 180 degrees with respect to a close position F1 with the axial member 3*b* serving as the pivot center B. Furthermore, the other end 2*b* is opened at 180 degrees with respect to the one end 2*a* so as to be flush therewith.

In contrast, with the door D2 arranged in the open position F2, when the door D2 is being closed, with an operation opposite to the above-described operation, the door D2 is arranged in the close position F1.

From the foregoing, with the hinge 1 according to the first embodiment, the one end 2*a* and the other end 2*b* of the sheet body 2, which is configured by layering sheet members, pivot relative to each other with the pivot shaft 3 serving as the pivot center B, which allows the door frame D1 and the door D2 to smoothly pivot relative to each other.

Furthermore, the sheet body 2 is formed of the sheet members, which makes it possible to attach the sheet body 2 to the door frame D1 and the door D2 without forming any recess for attachment in the door frame D1 and the door D2, so as to reduce an installation distance between the door frame D1 and the door D2. For example, when the sheet body 2 is formed of thin sheet members, it is possible to reduce the installation distance between the door frame D1 and the door D2.

The sheet body 2 is formed of flexible sheet members formed of fibers, which makes it possible to flexibly deform and attach the sheet body 2 on a fitting surface that is not a flat surface.

Providing the axial member 3*b* not only allows the door frame D1 and the door D2 to easily pivot with the axial member 3*b* serving as the pivot center B, but also increases the durability of the pivot shaft 3.

Providing the bulge 3*a* allows the one end 2*a* and the other end 2*b* to easily pivot relative to each other toward the first sheet member 21 side.

The pivot center B, which allows the one end 2*a* and the other end 2*b* to pivot relative to each other, is set so as to be decentered toward the one major face 22*a* side.

This decentering makes it possible to shift the pivot center B outward from the plane of each of the first sheet member 21 and the second sheet member 22. Thus, simply disposing the pivot center B outside the plane D11 and the D21 of the door frame D1 and the door D2 makes it possible to open and close the door D2 at 180 degrees with the hinge 1 prevented as much as possible from being exposed from the door frame D1 and the door D2.

Furthermore, disposing the axial member 3*b* between the highest bulge point 3*d* and the virtual line 22L on the one major face 22*a* makes it possible to easily open and close the door D2 at 180 degrees with the hinge 1 prevented as much as possible from being exposed from the door frame D1 and the door D2.

The first sheet member 21 and the second sheet member 22 include the fibers woven with inclination with respect to the pivot shaft 3. Thus, disposing the fibers with inclination downward from the door frame D1 to the door D2 allows the fibers to have durability in the longitudinal direction thereof against the pulling force due to the weight of the door D2, which makes it possible to easily open and close the door D2 without any descent of the door D2.

Providing the identification part 4 makes the position of the pivot shaft 3 easily visually recognized from the outside, and thus allows the hinge 1 to be easily mounted.

The hinge roll 10 is configured with a plurality of hinges 1 integrally rolled in a roll shape. This configuration makes it possible to bring the hinge roll 10 to a site where attachment of the hinge 1 is to be performed and easily attach the hinge 1 by cutting the hinge roll out at this site depending on the heights of the door frame D1 and the door D2 at the time of attachment of the hinge 1.

Specifically, the sheet body 2 has a very small thickness, which eliminates the necessity of shaving the door frame D1 and the door D2 at the site where the hinge 1 is to be attached, thereby reducing work time and unit price of the work.

Second Embodiment

Next, a second embodiment of the present invention will be described.

Figure 9:
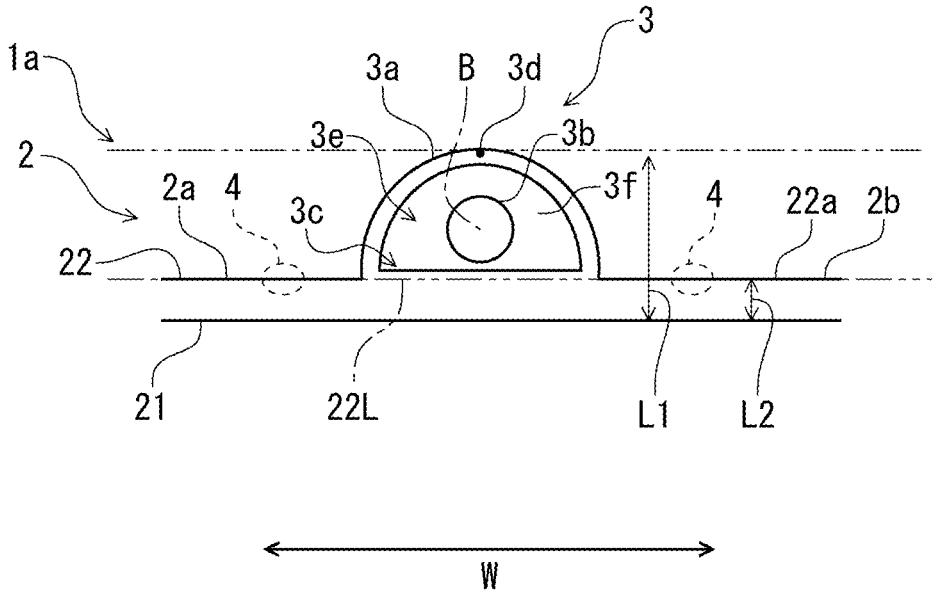
FIG. 9 is a sectional view illustrating a part of a hinge according to a second embodiment of the present invention.

FIG. 9 illustrates the second embodiment of the present invention.

In FIG. 9, the same components as those described in FIG. 1 to FIG. 8 have the same reference numerals and are not further elaborated.

The second embodiment has the same basic configuration as the basic configuration in the first embodiment, and different points are mainly explained.

A hinge 1*a* in the second embodiment includes a soft resin part 3*f* that is formed of soft resin. The soft resin part 3*f* is extended over the overall length in the height direction H in the inner space 3*c*.

This soft resin part 3*f* is provided when soft resin is filled in the inner space 3*c* with the axial member 3*b* disposed therein.

The soft resin part 3*f* is provided between the highest bulge point 3*d* and the virtual line 22L on the one major face 22*a*. Specifically, the soft resin part 3*f* is provided in the inner space 3*c* so as to be decentered toward the one major face 22*a* side.

The soft resin part 3*f* is disposed along the inner face of the bulge 3*a* and so as to be flush with the one major face 22*a*, and has a cross section that is formed in a semicircle shape.

From the foregoing, with the hinge 1*a* in the second embodiment, providing the soft resin part 3*f* allows the one end 2*a* and the other end 2*b* to easily pivot relative to each other with the pivot center B serving as a center.

Furthermore, providing the axial member 3*b* and the soft resin part 3*f* allows the one end 2*a* and the other end 2*b* to further easily pivot relative to each other with the pivot center B serving as a center.

Furthermore, disposing the soft resin part 3*f* between the highest bulge point 3*d* and the one major face 22*a* makes it possible to easily open and close the door D2 at 180 degrees with the hinge 1*a* prevented as much as possible from being exposed from the door frame D1 and the door D2.

Third Embodiment

Next, a third embodiment of the present invention will be described.

Figure 10:
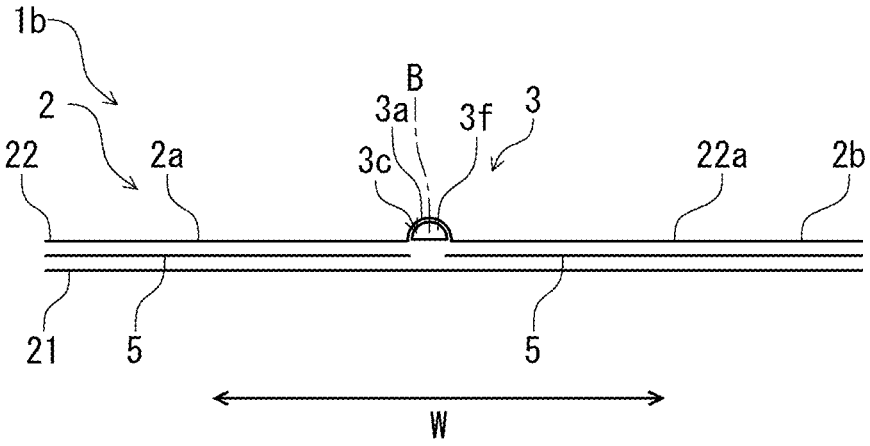
FIG. 10 is a sectional view illustrating a hinge according to a third embodiment of the present invention.

FIG. 10 illustrates the third embodiment of the present invention.

In FIG. 10, the same components as those described in FIG. 1 to FIG. 9 have the same reference numerals and are not further elaborated.

The third embodiment has the same basic configuration as the basic configuration in the first embodiment, and different points are mainly explained.

A hinge 1*b* in the third embodiment includes a reinforcing sheet (reinforcing plate) 5 disposed between the first sheet member 21 and the second sheet member 22.

The reinforcing sheet 5 is formed of metal, resin, or fiber, for example, and formed in a rectangular plate shape. Furthermore, the reinforcing sheet 5 is bonded to each of the one end 2*a* and the other end 2*b* with an adhesive agent.

It should be noted that in the third embodiment, the axial member 3*b* is not provided, but the soft resin part 3*f* alone is provided to the inner space 3*c*. In this case, the pivot center B is set inside the soft resin part 3*f*.

From the foregoing, with the hinge 1*b* in the third embodiment, providing the reinforcing sheet 5 allows the one end 2*a* and the other end 2*b* to be reinforced, thereby making it possible to increase allowable load with respect to the weight of a pivoting body to be attached.

It should be noted that while the reinforcing sheet 5 is provided to each of the one end 2*a* and the other end 2*b*, embodiments are not limited thereto and are changeable as appropriate. For example, the reinforcing sheet 5 made of metal, resin, or the like may be provided to each of the one end 2*a* and the other end 2*b*. The reinforcing sheet 5 made of fibers or the like may be integrally provided to both the one end 2*a* and the other end 2*b*, instead of being separately provided thereto.

Fourth Embodiment

Next, a fourth embodiment of the present invention will be described.

Figure 11:
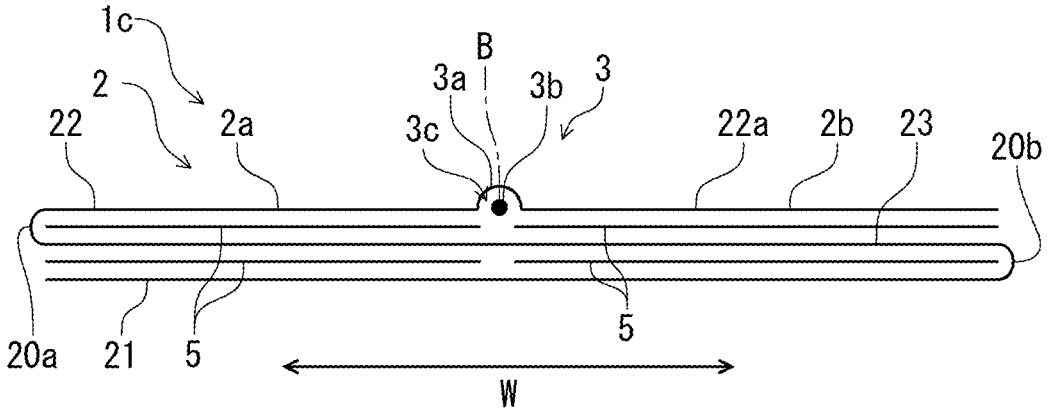
FIG. 11 is a sectional view illustrating a hinge according to a fourth embodiment of the present invention.

FIG. 11 illustrates the fourth embodiment of the present invention.

In FIG. 11, the same components as those described in FIG. 1 to FIG. 10 have the same reference numerals and are not further elaborated.

The fourth embodiment has the same basic configuration as the basic configuration in the first embodiment, and different points are mainly explained.

A hinge 1*c* in the fourth embodiment includes a third sheet member 23 disposed between the first sheet member 21 and the second sheet member 22. The first sheet member 21, the second sheet member 22, and the third sheet member 23 are integrally connected to one another. Specifically, the first sheet member 21, the second sheet member 22, and the third sheet member 23 are constituted of one sheet member that is folded. More specifically, one end of each of the first sheet member 21 and the third sheet member 23 includes a connecting part 20*a* serving as a folding portion. The other end of each of the second sheet member 22 and the third sheet member 23 includes a connecting part 20*b*.

The reinforcing sheet 5 is provided to between the first sheet member 21 and the third sheet member 23, and between the second sheet member 22 and the third sheet member 23.

From the foregoing, with the hinge 1*c* in the fourth embodiment, providing the third reinforcing sheet 23 allows the one end 2*a* and the other end 2*b* to be reinforced, thereby making it possible to increase allowable load with respect to the weight of a pivoting body to be attached.

The one sheet member folded to constitute the sheet body 2 allows the hinge 1*c* to be easily manufactured.

Providing the connecting part 20*a* and 20*b* allows the connection of the first sheet member 21, the second sheet member 22, and the third sheet member 23 to be reinforced.

It should be noted that in the fourth embodiment, while the first sheet member 21, the second sheet member 22, and the third sheet member 23 are integrally connected, embodiments are not limited thereto, and the first sheet member 21, the second sheet member 22, and the third sheet member 23 which are separate members may be connected via the connecting part 20*a* and the connecting part 20*b*.

It should be noted that while the reinforcing sheet 5 is provided to each of the one end 2*a* and the other end 2*b*, embodiments are not limited thereto and are changeable as appropriate. For example, the reinforcing sheet 5 made of metal, resin, or the like may be provided to each of the one end 2*a* and the other end 2*b*. The reinforcing sheet 5 made of fibers or the like may be integrally provided to both the one end 2*a* and the other end 2*b*, instead of being separately provided thereto.

Moreover, while one piece of the third sheet 23 is provided, embodiments are not limited thereto, and the number of pieces installed is changeable as appropriate. For example, two or more pieces of the third sheet 23 may be provided. Consequently, depending on the installation condition, it is possible to adjust the strength of the sheet body 2.

A two-layer sheet body 2 as in other embodiments may be configured with one piece of a sheet member folded as in the fourth embodiment without the third sheet member 23.

Specifically, the first sheet member 21 and the second sheet member 22 may be folded with the connecting part interposed therebetween, so as to be integrally connected to configure the sheet body 2.

Fifth Embodiment

Next, a fifth embodiment of the present invention will be described.

Figure 12:
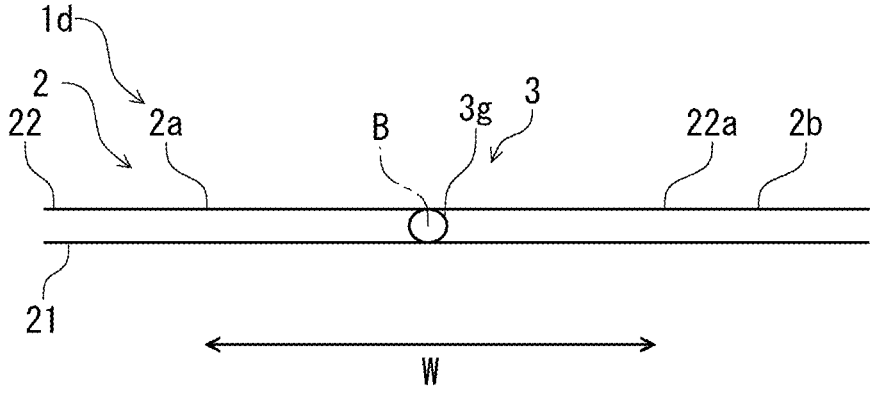
FIG. 12 is a sectional view illustrating a hinge according to a fifth embodiment of the present invention.

FIG. 12 illustrates the fifth embodiment of the present invention.

In FIG. 12, the same components as those described in FIG. 1 to FIG. 11 have the same reference numerals and are not further elaborated.

The fifth embodiment has the same basic configuration as the basic configuration in the first embodiment, and different points are mainly explained.

The pivot shaft 3 in the fifth embodiment is configured to include a soft resin part 3*g* extending over the overall length in the height direction H. The soft resin part 3*g* is provided between the first sheet member 21 and the second sheet member 22.

It should be noted that neither the bulge 3*a* nor the axial member 3*b* is provided in the fifth embodiment.

From the foregoing, with the hinge 1*d* in the fifth embodiment, a simple configuration allows the one end 2*a* and the other end 2*b* to easily pivot relative to each other with the pivot center B serving as a center.

It should be noted that in the fifth embodiment, an axial member may be provided instead of the soft resin part 3*g*, or both the soft resin part 3*g* and the axial member may be provided.

While some embodiments of the present invention have been described above, the present invention is not limited to the above-described embodiments, and it is possible to make various modifications and changes.

Figure 13:
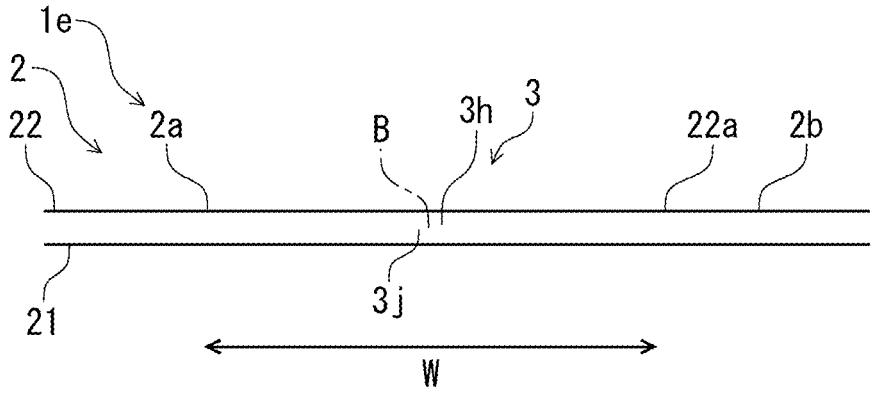
FIG. 13 is a sectional view illustrating a first modification of the hinge according to the present invention.

For example, while the pivot shaft 3 includes an axial member, a soft resin part, a bulge, and the like, the combination of these components is changeable as appropriate. For example, an axial member alone, a soft resin part alone, or a bulge alone may be provided, or a combination of an axial member and a soft resin part, an axial member and a bulge, or a soft resin part and a bulge may be provided. Furthermore, as illustrated in FIG. 13, the hinge 1*e* need not necessarily include an axial member, a soft resin part, and a bulge. In this case, an inner space 3*h* formed between the first sheet member 21 and the second sheet member 22 is a cavity 3*j* and this cavity 3*j* serves as the pivot shaft 3. Under such configuration, in the center between the first sheet member 21 and the second sheet member 22, a pivot center B is set. With this pivot center B as the center, the one end 2*a* and the other end 2*b* pivot relative to each other.

Figure 14:
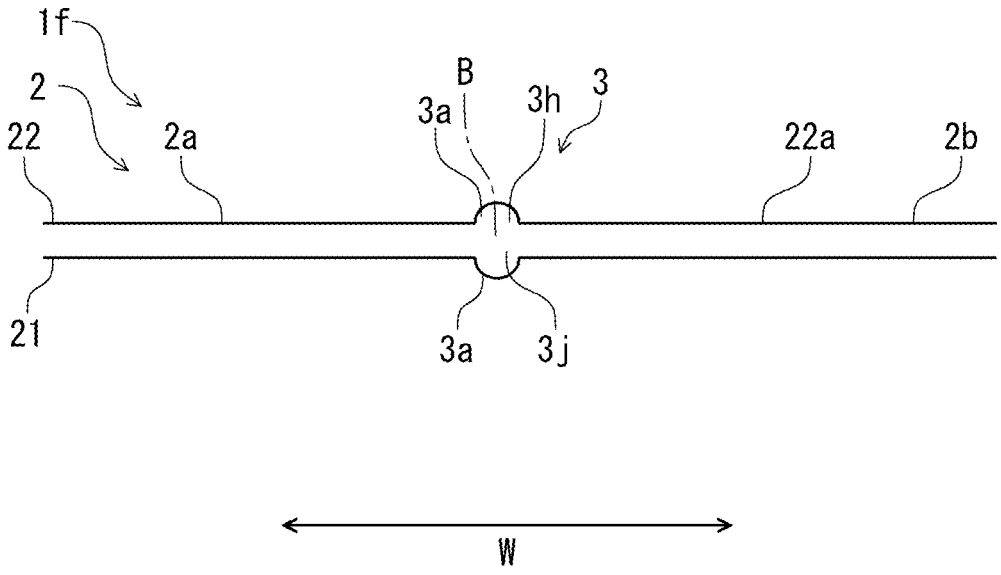
FIG. 14 is a sectional view illustrating a second modification of the hinge according to the present invention.
Figure 15:
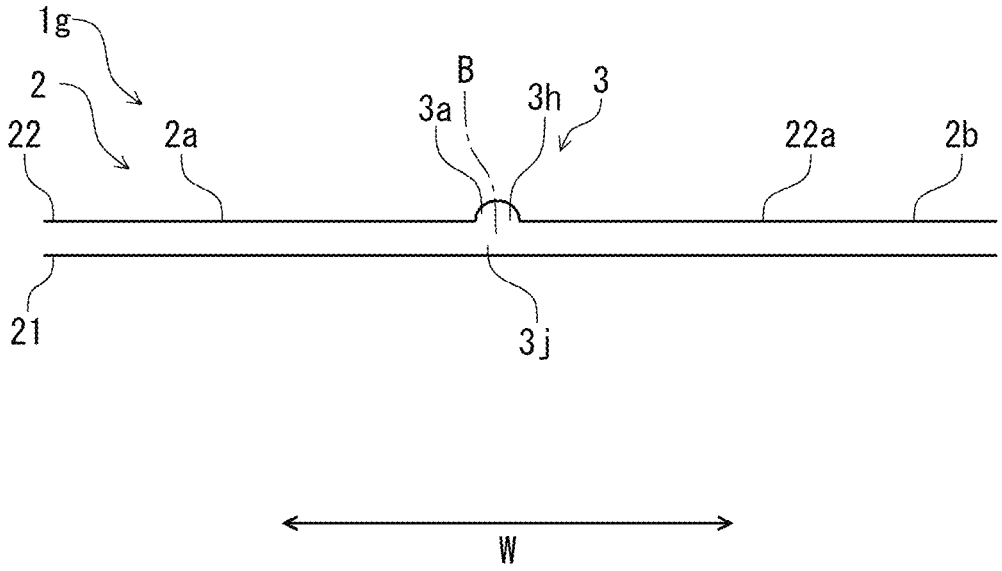
FIG. 15 is a sectional view illustrating a third modification of the hinge according to the present invention.

While the bulge 3*a* is provided to the second sheet member 22, embodiments are not limited thereto and the bulge 3*a* may be provided to at least one of the first sheet member 21 and the second sheet member 22. For example, as illustrated in FIG. 14, the hinge 1*f* may have the bulge 3*a* provided to both the first sheet member 21 and the second sheet member 22. In this case, the cavity 3*j* can reasonably include an axial member, a soft resin part, and the like. As illustrated in FIG. 15, the first sheet member 21 in the hinge 1*g* may include the bulge 3*a* and the inside of the bulge 3*a* may be the cavity 3*j*. In this case, the cavity 3*j* can reasonably include an axial member, a soft resin part, and the like.

Figure 16A:
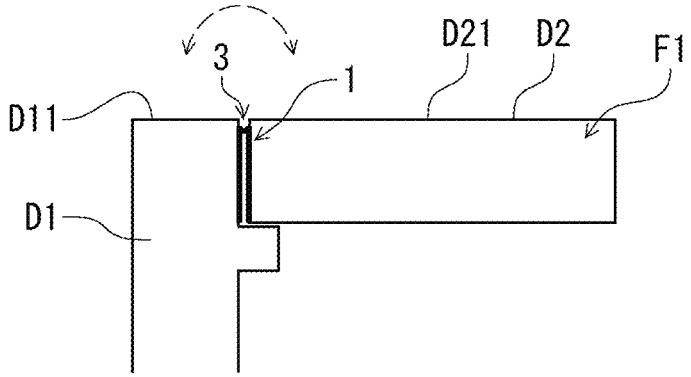
FIGS. 16A to 16C illustrate the hinge in FIG. 1 attached to a door frame and a door in a direction different from that in FIGS. 6A to 6C, FIG. 16A being an explanatory diagram illustrating the door being closed, FIG. 16B being an explanatory diagram illustrating the door being opened at 90 degrees, and FIG. 16C being an explanatory diagram illustrating the door being opened at 180 degrees.
Figure 16B:
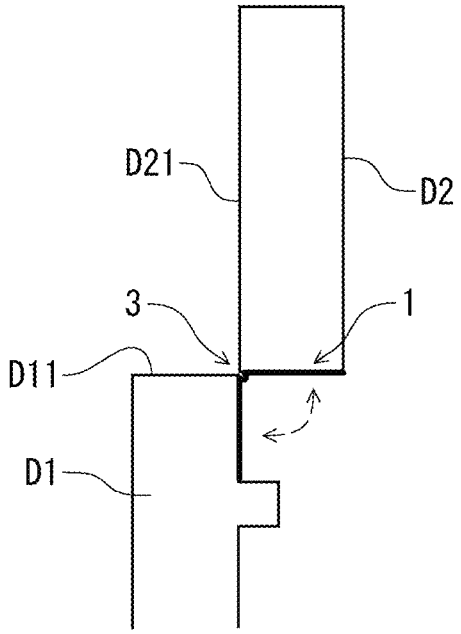
Figure 16C:
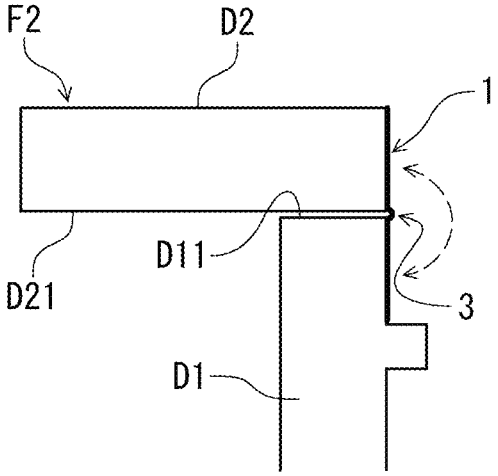

With the door D2 disposed in the close position F1, the pivot shaft 3 is disposed on a position that projects from the plane D11 of the door frame D1 and the plane D21 of the door D2, but embodiments are not limited thereto, and a position where the hinge is disposed is changeable as appropriate. For example, as illustrated in FIG. 16A to 16C, with the door D2 disposed in the close position F1, the pivot shaft 3 may be disposed in a position that is recessed toward the inside from the plane D11 of the door frame D1 and the plane D21 of the door D2.

While the bulge 3*a* is formed so as to bulge in a curved manner, embodiments are not limited thereto and are changeable as appropriate. For example, the bulge 3*a* may bulge in a triangle shape or a polygon shape.

The pivot center B may be located at any position from the center part between the first sheet member 21 and the second sheet member 22 to the highest bulge point 3*d*. For example, the position may be on the virtual line 22L. The pivot center B may be disposed, without being decentered in the one major face 22*a* side, in the center part between the first sheet member 21 and the second sheet member 22.

While the soft resin part is provided so as to be decentered in the one major face 22*a* side, embodiments are not limited thereto, and the soft resin part may be disposed in the center part between the first sheet member 21 and the second sheet member 22. It should be noted that decentricity refers to a condition in which the pivot center B is disposed at any position from the center part between the first sheet member 21 and the second sheet member 22 to the highest bulge point 3*d*, and the soft resin part may be disposed at any position from the highest bulge point 3*d* to the inner surface of the first sheet member 21.

While the axial member is provided so as to be decentered in the one major face 22*a* side, embodiments are not limited thereto, and the soft resin part may be disposed in the center part between the first sheet member 21 and the second sheet member 22. It should be noted that the pivot center B is disposed at any position from the center part between the first sheet member 21 and the second sheet member 22 to the highest bulge point 3*d*, and the soft resin part may be disposed at any position from the highest bulge point 3*d* to the inner surface of the first sheet member 21.

Moreover, while the fibers of the sheet body 2 are provided with inclination at 45 degrees with respect to the pivot shaft 3, embodiments are not limited thereto, and the angle is changeable as appropriate. At least one of the first sheet member 21 and the second sheet member 22 may be fibers. Furthermore, the fibers may be provided without inclination.

While the identification part 4 is a line of a stitched seam, embodiments are not limited thereto and are changeable as appropriate. For example, a line may be drawn, a tape may be applied, or the identification part 4 may be formed by such as coloring and printing. Alternatively, this identification part 4 need not be necessarily provided.

While the reinforcing sheet 5 is provided between the first sheet member 21 and the second sheet member 22, embodiments are not limited thereto, and the reinforcing sheet 5 may be provided outside the first sheet member 21 and the second sheet member 22. This reinforcing sheet 5 need not be necessarily provided.

While examples of fiber material for the sheet body 2 include carbon fibers, embodiments are not limited thereto and are changeable as appropriate. For example, the fiber material may be Kevlar fibers, aramid fibers, Spectra (registered) fiber, Ultra high molecular weight polyethylene fiber, Zylon (registered) fibers, and the like. Furthermore, the sheet body 2 may be made of resin or metal instead of fiber material.

Positions on the door frame D1 and the door D2 to which the hinge is attached are changeable as appropriate. For example, the hinge may be attached over the overall length in the height direction H of the door frame D1 and the door D2, or may be attached to part of or multiple positions of each of the door frame D1 and the door D2 in the height direction H.

While the one pivoting body is the door frame D1 and the other pivoting body is the door D2, embodiments are not limited thereto, and types, shapes, or the like of pivoting bodies are changeable as appropriate. Not only either one of the pivoting bodies may pivot relative to the other pivoting body that is fixed, but also both pivoting bodies may pivot together relative to each other.

While the pivot center B extends along the vertical direction, embodiments are not limited thereto and are changeable as appropriate. For example, with the pivot center B disposed horizontally, one pivoting body and the other pivoting body may pivot vertically relative to each other, or the pivot center B may be inclined.

While the first sheet member 21 and the second sheet member 22 are bonded to one another with an adhesive agent, embodiments are not limited thereto, and means of bonding is changeable as appropriate. Furthermore, the first sheet member 21 and the second sheet member 22 need not be necessarily bonded to one another.

While the axial member 3*b* is made of a nylon wire, embodiments are not limited thereto and are changeable as appropriate. For example, the axial member 3*b* may be a piano wire, a hard steel wire or fibers, or the like.

While the pivot shaft 3 is provided over the overall length in the height direction H, embodiments are not limited thereto and may be provided to part of or multiple positions in the height direction H dispersedly.

Figure 17A:
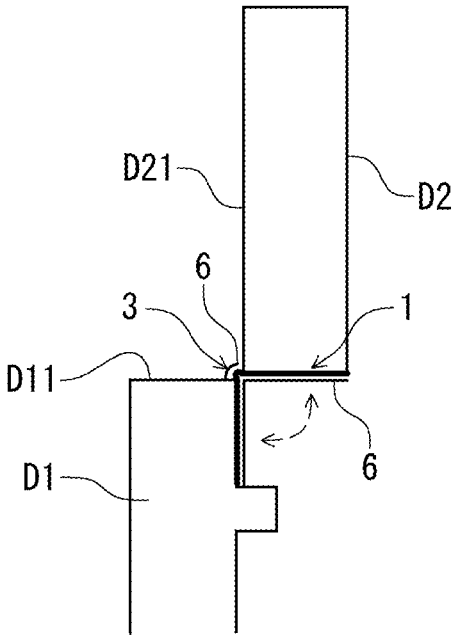
FIGS. 17A to 17B are diagrams illustrating a fourth modification according to the present invention, FIG. 17A being an explanatory diagram illustrating the sheet body in FIG. 6B provided with a design part and FIG. 17B being an explanatory diagram illustrating the sheet body in FIG. 16B provided with a design part.
Figure 17B:
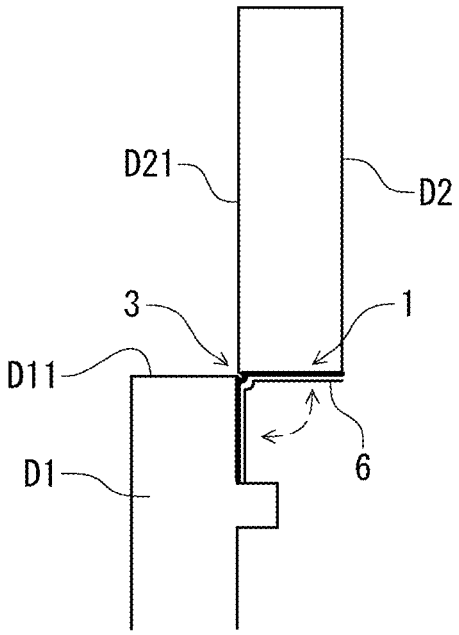

As illustrated in FIG. 17A or 17B, a surface of the sheet body 2 can be provided with a design part 6. The design part 6 covers the whole surface of the sheet body 2, and the surface of the design part 6 has design. Specifically, the design part 6 serves as a design set depending on colors, patterns, or the like of pivoting bodies to which the sheet body 2 is attached. Consequently, when the design part 6 has the same color and the pattern as those of the pivoting bodies (for example, the same material, the same paint, and the like), the design part 6 can be prevented from being conspicuous from the outside, or when the design part 6 has different colors or patterns from those of the pivoting bodies (for example, different material, different paint, or the like), the design properties can be improved. It should be noted that the design of the design part 6 can be made with various methods such as painting, printing, and embossing, for example. The design part 6 includes a part covering the first sheet member 21 and another part covering the second sheet member 22, designs of which parts may be different from each other. While the design part 6 covers the whole surface of the sheet body 2, embodiments are not limited thereto and the design part 6 may cover at least part of the sheet body 2.

While the pivot shaft 3 is provided to the center part of the sheet body 2 in the width direction W, embodiments are not limited thereto and are changeable as appropriate. For example, depending on the thicknesses or the like of the door frame D1 and the door D2, the pivot shaft 3 may be disposed closer to one side of the sheet body 2 in the width direction W.

While the pressing die E has the recess E1 formed thereon, embodiments are not limited thereto and are changeable as appropriate. For example, the pressing die E may have a through hole provided thereon instead of the recess E1.

A plurality of hinges of any of the above-described various types can be integrally formed in a roll shape so as to make a hinge roll. The hinges may also be formed as separate hinges instead of being formed in a hinge roll.

Regarding the described embodiments, the following Notes will be further presented.

Note 1

A hinge to connect one pivoting body to another pivoting body in a relatively pivotable manner, the hinge including a sheet body that is configured by layering sheet members, one end of the sheet body being attachable to the one pivoting body and another end of the sheet body being attachable to the other pivoting body, the sheet body including a pivot shaft that is disposed between the layered sheet members so as to allow the one end and the other end of the sheet body to pivot relative to each other.

Note 2

The hinge of Note 1, in which the pivot shaft includes a soft resin part disposed between the sheet members that are layered.

Note 3

The hinge of Note 1 or Note 2, in which the pivot shaft includes an axial member disposed between the sheet members that are layered.

Note 4

The hinge of Note 1, in which the pivot shaft includes a cavity provided between the sheet members that are layered.

Note 5

The hinge of any one of Note 1 to Note 4, in which the pivot shaft includes a bulge that is set such that the sheet member on one major face of the sheet body projects outward and a distance between the sheet members increases toward the one major face compared with a distance between the sheet members at the one end or the other end of the sheet body.

Note 6

The hinge of Note 5, in which a pivot center that allows the one end and the other end of the sheet body to pivot relative to each other is set inside the bulge and between the one major face and a highest bulge point of the bulge.

Note 7

The hinge of Note 6 depending from Note 2, in which the soft resin is provided between the one major face and the highest bulge point of the bulge.

Note 8

The hinge of Note 6 depending from Note 3, in which the axial member is disposed between the one major face and the highest bulge point of the bulge.

Note 9

The hinge of any one of Note 1 to Note 8, in which the sheet member is formed of fiber material, and the sheet body being configured with at least part of the fibers woven with inclination with respect to the pivot shaft.

Note 10

The hinge of any one of Note 1 to Note 8, in which the sheet body includes an identification part for identifying the pivot shaft.

Note 11

The hinge of any one of Note 1 to Note 10, in which at least one of the one end and the other end is provided with a reinforcing plate between the sheet members or outside the sheet members.

Note 12

The hinge of any one of Note 1 to Note 11, in which the hinge has a design part that covers at least part of the sheet body.

Note 13

A hinge roll that is configured with a plurality of the hinges of any one of Note 1 to Note 12 integrally rolled in a roll shape.

The invention claimed is:

1. A hinge configured to connect a first pivoting body to a second pivoting body in a relatively pivotable manner, the hinge comprising a sheet body configured to attach a first end of the sheet body to the first pivoting body, and to attach a second end of the sheet body to the second pivoting body, the sheet body including:

a plurality of layered sheet members, and a pivot shaft between layered sheet members of the plurality of layered sheet members to allow the first end and the second end of the sheet body to pivot relative to each other, the pivot shaft including a bulge projecting outwardly at one layered sheet member of the plurality of layered sheet members on a major face of the sheet body, wherein the bulge is configured to increase a distance between the layered sheet members toward the major face compared with a distance between the layered sheet members at the first end or the second end of the sheet body, and a pivot center configured to allow the first end and the second end of the sheet body to pivot relative to each other is inside the bulge and between the major face and a highest bulge point of the bulge.

2. The hinge according to claim 1, wherein the pivot shaft further includes a cavity between the layered sheet members.

3. The hinge according to claim 1, wherein the pivot shaft further includes a soft resin part between the layered sheet members, and the soft resin part is between the major face and the highest bulge point of the bulge.

4. The hinge according to claim 1, wherein the pivot shaft further includes an axial member between the layered sheet members, and the axial member is between the major face and the highest bulge point of the bulge.

5. The hinge according to claim 1, further comprising a design part covering at least part of the sheet body.

6. The hinge according to claim 1, wherein at least one of the plurality of layered sheet members includes fiber material, and the sheet body has at least part of the fiber material woven with inclination with respect to the pivot shaft.

7. The hinge according to claim 1, wherein the sheet body further includes an identification part for identifying the pivot shaft.

8. The hinge according to claim 1, wherein at least one of the first end or the second end has a reinforcing plate between the layered sheet members or outside the layered sheet members.

9. The hinge according to claim 2, wherein at least one of the first end or the second end has a reinforcing plate between the layered sheet members or outside the layered sheet members.

10. The hinge according to claim 1, wherein the bulge projects outwardly at the one layered sheet member of the plurality of layered sheet members on the major face of the sheet body in an open state, wherein an angle between the first end of the sheet body and the second end of the sheet body is 180°.

11. The hinge according to claim 1, wherein the plurality of layered sheet members includes:

a first sheet member, and a second sheet member layered over the first sheet member in a first direction, the bulge projects outwardly at the second sheet member away from the first sheet member in the first direction, and a surface of the second sheet member defining the bulge corresponds to the major face of the sheet body.

12. The hinge according to claim 1, wherein the plurality of layered sheet members includes:

a first sheet member, and a second sheet member layered over the first sheet member in a first direction, and the pivot shaft further includes a cavity between the first sheet member and the second sheet member in the first direction.

* * * * *